US007305911B2

(12) United States Patent
Regebro

(10) Patent No.: US 7,305,911 B2
(45) Date of Patent: Dec. 11, 2007

(54) METHOD AND DEVICE FOR LAUNCHING FREE-FLYING PROJECTILES

(75) Inventor: Christer Regebro, Eskilstuna (SE)

(73) Assignee: SAAB AB, Linköping (SE)

( * ) Notice: Subject to any disclaimer, the term of this patent is extended or adjusted under 35 U.S.C. 154(b) by 71 days.

(21) Appl. No.: 10/968,267

(22) Filed: Oct. 20, 2004

(65) Prior Publication Data

US 2007/0256552 A1 Nov. 8, 2007

(30) Foreign Application Priority Data

Oct. 20, 2003 (EP) ..... 03445116

(51) Int. Cl.
*F41A 1/08* (2006.01)

(52) U.S. Cl. ..... 89/1.701; 89/1.7

(58) Field of Classification Search ..... 89/1.701, 89/1.703, 1.702, 1.704, 1.705, 1.706; 102/437; 42/1.06

See application file for complete search history.

(56) References Cited

U.S. PATENT DOCUMENTS 4,406,209 A 9/1983 Arene et al.
4,574,680 A * 3/1986 Nicodemus ..... 89/1.701
4,676,136 A * 6/1987 Kalin ..... 89/1.701
5,313,870 A 5/1994 Clark
5,357,841 A * 10/1994 Clark et al. ..... 89/1.701
5,952,601 A * 9/1999 Sanford et al. ..... 89/1.706
5,965,836 A * 10/1999 Rakov ..... 89/1.7
6,446,535 B1 * 9/2002 Sanford et al. ..... 89/1.701
6,543,329 B2 * 4/2003 Sanford et al. ..... 89/1.701
6,971,299 B2 * 12/2005 Franzen et al. ..... 89/1.701

FOREIGN PATENT DOCUMENTS

GB 2 314 913 A 1/1998
WO WO 89/04451 5/1989
WO WO 03064956 A1 * 8/2003

* cited by examiner

*Primary Examiner*—Troy Chambers
*Assistant Examiner*—Stewart T. Knox
(74) *Attorney, Agent, or Firm*—Venable LLP; Eric J. Franklin

(57) ABSTRACT

The present invention relates to a method and a device by means of which it has been made possible, without gas discharge to the surrounding environment, to accelerate the speed of a powder-gas-driven projectile from zero to a speed which gives the projectile free-flying characteristics. According to the invention, this has been made possible by utilizing at least some of the expansion force from the propellant powder charge, which discharges gas when it is initiated, for, by a displaceable piston, driving a countermass out of the rear part of the projectile in the direction opposite to the desired flying direction of the projectile.

5 Claims, 2 Drawing Sheets

METHOD AND DEVICE FOR LAUNCHING FREE-FLYING PROJECTILES

CROSS-REFERENCE TO RELATED APPLICATIONS

This application claims priority to European patent application 03445116.1 filed 20 Oct. 2003.

The present invention relates to a method and a device for launching free-flying projectiles and primarily those which form part of heavier carried support weapons such as antitank rifles, antitank grenade launchers and lighter antitank missiles. The particularly great advantage of the invention is that it makes it possible to develop effective weapons of the types mentioned above which are well-suited for firing from inside buildings or other largely closed spaces.

BACKGROUND

It is increasingly clear that combat in buildings is a very likely scenario in the future, irrespective of whether it is a matter of an international effort, defense against invasion or combating terrorism. Combat in buildings in turn requires it to be possible for firing with all carried weapons to be carried out inside buildings or out from buildings. To have to run outdoors as soon as it is intended to open fire involves losing time but above all leaving the protection the building after all offers. It has to be possible for firing indoors to be carried out without risk to weapon operators or other people in the same or adjoining room or space.

PROBLEM

However, modern heavy carried support weapons of the antitank rifle, antitank grenade launcher and lighter antitank missile type give rise to violent pressure surges which, owing to the fact that indoors they will be reflected over and over again against walls and corners and back towards the weapon operator, exceed many times over the level a person tolerates without functional impairment. They also give rise to toxic gases such as primarily CO and NOx but also hydrochloric acid, lead dust and other heavy metals, and they moreover leave clear signatures in the form of flames and smoke.

ADVANTAGES OF THE INVENTION

The main advantages of the method and the device according to the invention are that the launching methodology introduced therein does not give rise to any pressure surges which are disturbing for the weapon operator or his comrades at the same time as it gives rise to only low sound pressure and, in its most refined variant, no dangerous gases whatsoever, and this notwithstanding the fact that the launching takes place by means of combustion of what is in principle an entirely conventional propellent powder charge. Perhaps the most considerable advantage of the method according to the invention is furthermore that launching takes place without the propellent powder charge utilized in this connection giving rise to any open flame or smoke which would reveal the position of the weapon operator when firing takes place. The invention is based on a modified use of what is known as a countermass which is accelerated backwards by the propellent powder charge in relation to the desired flying direction of the projectile concerned at the same time as the projectile is accelerated to the desired speed in the intended flying direction.

STATE OF THE ART

Antitank rifles, antitank grenade launchers and lighter antitank missiles but also some other slightly heavier weapons which function according to the countermass principle have been in service in the majority of armies for several years. With one or a few exceptions, however, these weapons which exist today have been completely impossible to fire from closed confined spaces without the crew handling the weapon having been exposed to great risks and in most cases very serious injuries. By utilizing countermass instead of the refined blowback principle, it is true that it has been possible to reduce considerably the quantity of propellent powder necessary in order to give the projectile a certain desired launching speed, but risks still remain then in the form of signature, particles, irritating substances, toxic gases, high sound pressure and the pressure increase still present when the projectile and the countermass leave the muzzle of the barrel and, respectively, its rear outlet.

If the weapon does not discharge the powder gases, no flame, pressure or signature originates from these either. It is then also easier to select possible countermasses which have less of a signature and irritating capacity.

At least one weapon which functions in this way exists today, and there are probably several similar at the experimental stage. These weapons are probably based on utilization of two movable pistons built into the launching device or barrel of the weapon, which are driven away from one another when combustion of a propellent powder charge included in the weapon takes place, the front piston accelerating the projectile forwards out of the barrel in the desired firing direction while the rear one drives the countermass backwards out of the rear outlet of the barrel. When the pistons reach the respective ends of the barrel, they are braked and provide a seal against the powder gases. The barrel of the weapon has thus been transformed into a high-pressure container with a considerable internal pressure, from which the confined powder gases are allowed to escape slowly.

The disadvantage of this solution is that the barrel of the weapon has to be made very heavy in order to be capable of stopping the pistons and that it is a non-reloadable single-use weapon, the existence of which as a pressurized gas container after firing could involve a certain risk factor.

PROPOSED SOLUTION

In accordance with the present invention, it is now proposed instead that the propellent powder charge and the countermass are moved from the launching device or the barrel and are instead built into the projectile, and that use is made of a single displaceable piston which, when combustion of the propellent powder charge takes place, is displaced inside the projectile and in the course of this drives the countermass out of the rear part of the projectile at the same time as the projectile is accelerated in the opposite direction. This means that the projectile is somewhat heavier to begin with but that the barrel of the weapon, which therefore, in this development of the piston-driving principle, does not then have to be capable of taking up either the movements of the pistons or the internal powder gas pressure, can be made lighter and at the same time is reloadable immediately after firing.

The projectile designed in accordance with the present invention will therefore contain the necessary payload, a propellent powder charge in a reinforced rear pressure chamber designed therefor, a piston which can be displaced backwards in relation to the intended flying direction of the projectile in the pressure chamber, and, behind this piston, a simple countermass which could consist of, for example, suitably packed steel shot. At the same time, the barrel of the weapon can, in contrast to the more heavily constructed projectile, be made relatively light as it will never be subjected to any high internal pressure. On the other hand, the barrel must of course comprise the necessary firing and sight functions.

When the weapon according to the invention is fired, the propellent powder charge is thus ignited, the pressure in front of the piston then increasing, which results in the latter, inside the pressure chamber, being driven backwards in relation to the intended flying direction of the projectile at the same time as it drives the countermass out of a rear opening in the projectile chamber, which means that the projectile is at the same time accelerated in the intended flying direction. When the piston approaches the rear end of the chamber, it is braked by, for example, deformation against shoulders or stops arranged in the chamber wall. The projectile and the countermass are nevertheless not hindered in their movements but leave the barrel through the front and, respectively, rear outlets thereof without in doing so giving rise to any flame, smoke or other detectable signature. The projectile therefore continues with its built-in high-pressure chamber towards the intended target at the same time as the barrel of the weapon can immediately be reloaded and fired again. With the weapon, no risks remain for the weapon operator or anyone around him.

BRIEF SUMMARY OF THE ADVANTAGES OF THE INVENTION

Gastight, signatureless firing, low sound pressure which allows firing without ear protectors even in small spaces. Reloadable light launching device in a weapon which can be provided with high performance with launching speeds of over 200 m/s and allows relatively heavy active parts to be launched directly from the shoulder.

The method and the device according to the invention have been defined in the patent claims below and will now be described in somewhat greater detail in connection with accompanying figures.

All components have been given the same reference designations in the various figures.

DETAILED DESCRIPTION OF EMBODIMENTS OF THE INVENTION

Figure 1:
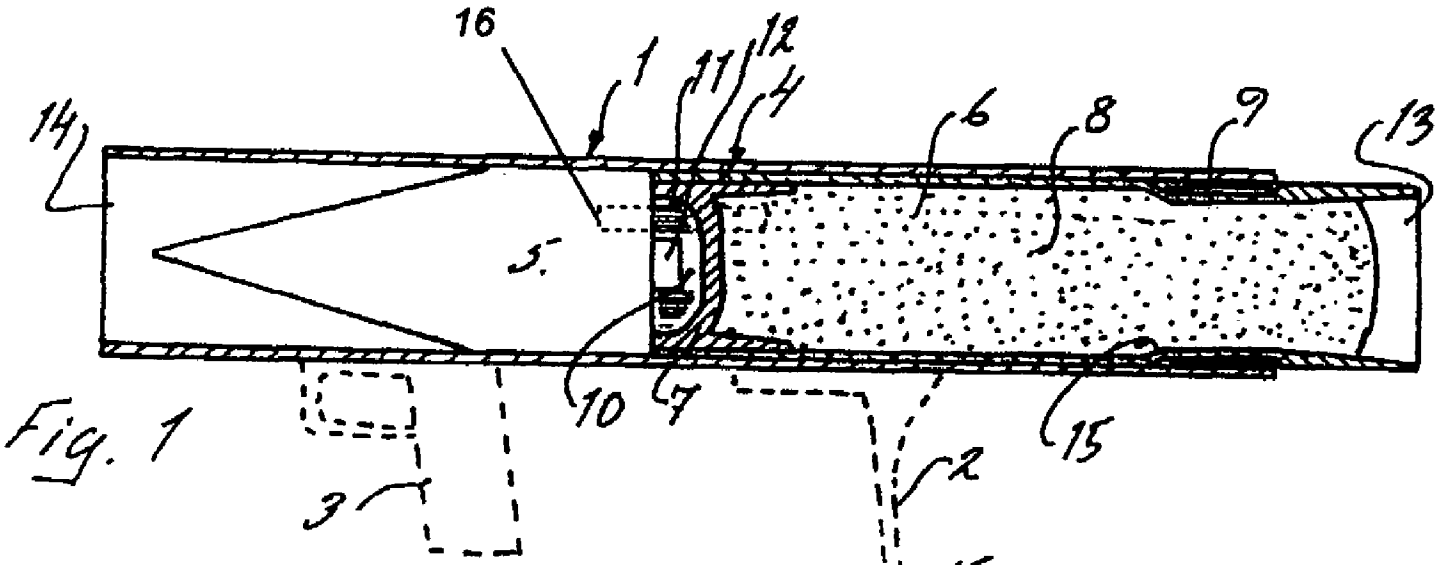
FIGS. 1 and 2 show a sectioned projection of an antitank weapon according to the invention immediately before and during the initial launching phase of the projectile included therein.
Figure 2:
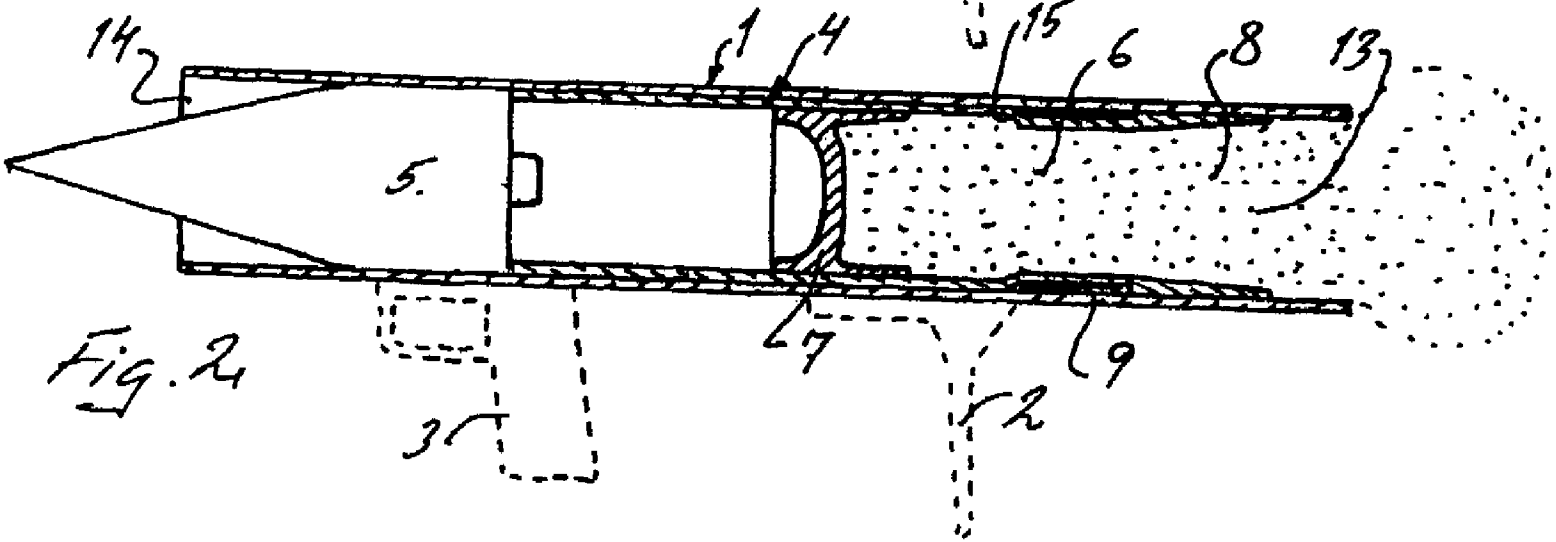

The weapon shown in the figures comprises a barrel 1 with a shoulder rest 2, sights 16, and a pistol grip, with firing means 3, intended for the weapon operator. The weapon also comprises a projectile 4 with an active load 5 and a rear pressure chamber 6 in which an axially displaceable piston 7 is arranged. To begin with, that is to say until the weapon is fired, the main part of this pressure chamber is filled by a countermass 8 which can consist of, for example, steel shot packed in a suitable manner. The projectile 4 is also provided with fins 9 which are folded in FIGS. 1 and 2. Furthermore, a charging compartment 10 is arranged in the front part of the piston 7 facing the active load. To begin with, this charging compartment contains a propellent powder charge 11 and an igniter 12.

Figure 3:
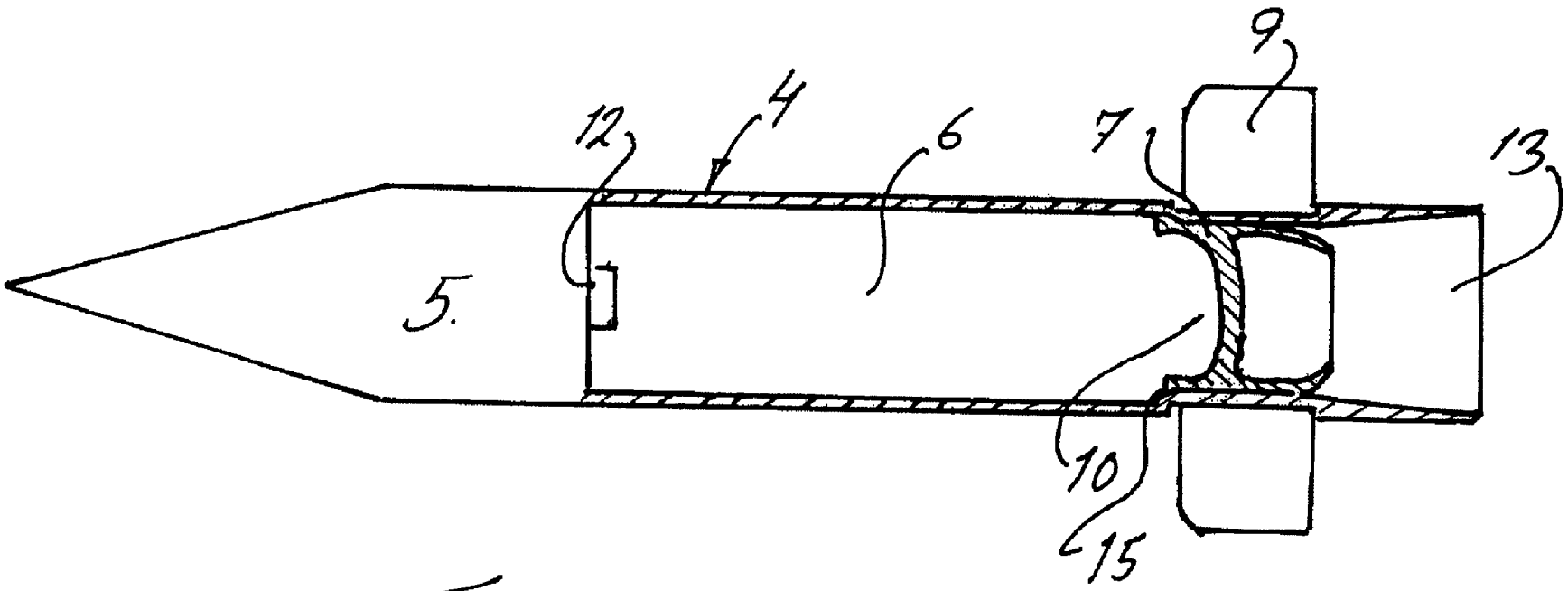
FIG. 3 shows the likewise sectioned projectile after it has left the barrel of the weapon and is on its way towards its target.

When the weapon is fired, the propellent powder charge 11 is initiated by the igniter 12, and the powder gases then formed drive the piston 7 backwards in relation to the firing direction of the weapon inside the pressure chamber 6 at the same time as the countermass 8 starts to be forced out through the rear outlet 13 of the projectile and the projectile 4 is accelerated forwards in the firing direction a of the weapon and out of the muzzle 14 of the barrel 1. At the moment when all the countermass has left the pressure chamber 6, the piston 7 will have reached its rearmost position in the pressure chamber 6, and the piston will be blocked in this position by, for example, being compressed firmly so that the powder gases which to begin with drive the piston are retained inside the pressure chamber. In order to illustrate this, a projecting edge 15 has been drawn in the figures. As can be seen from FIG. 3, the fins 9 are folded out when the projectile goes into free flight. The same figure shows the piston 7 in a firmly compressed sealed position.

The expression pressure chamber has been used above for the space 6 to begin with as well, when this space is occupied by the countermass 8, but this space does not actually become a pressure chamber until the charging compartment 10 has been enlarged to comprise this space as well by the displacement of the piston 7. In the patent claims and the abstract, the expression pressure chamber has therefore been given the reference designation 6, 10.

The invention claimed is:

1. A powder-gas-driven free-flying projectile, comprising:

an active load arranged in a front of the projectile;

a propellant powder charge arranged behind the active load, wherein gases formed by combustion of the propellant powder charge accelerate the projectile to a flying speed in a flying direction;

an igniter operative to initiate combustion of the propellant powder charge;

a piston arranged behind and adjacent the propellant powder charge, such that gases formed upon initiation of combustion of the propellant powder act directly on the piston to displace the piston in a direction opposite to the flying direction simultaneously with accelerating the projectile in the flying direction;

a countermass arranged behind the piston such that movement of the piston displaces the countermass in the direction opposite to the flying direction and out of the projectile; and a projecting edge operative to permit the countermass to pass out of the projectile and to receive the piston therein, and to engage, brake and compress the piston as it is displaced in the direction opposite to the flying direction and passes the projecting edge, thereby sealing the projectile and retaining the gases formed by combustion of the propellant charge within the projectile.

2. The powder-gas-driven free-flying projectile according to claim 1, wherein the propellant powder charge, an igniter, piston, countermass, and projecting edge are arranged in a pressure chamber arranged behind the active load.

3. The powder-gas-driven free-flying projectile according to claim 1, further comprising:

fins operative to stabilize flight of the projectile.

4. A weapon, comprising:

a powder-gas-driven free-flying projectile comprising an active load arranged in a front of the projectile, a propellant powder charge arranged behind and adjacent the active load, wherein gases formed upon initiation of combustion of the propellant power charge accelerate the projectile to a flying speed in a flying direction simultaneously with accelerating the projectile in the flying direction, an igniter operative to initiate combustion of the propellant powder charge, a piston arranged behind the propellant powder charge, such that gases formed by combustion of the propellant powder act directly on the piston to displace the piston in a direction opposite to the flying direction, a countermass arranged behind the piston such that movement of the piston displaces the countermass in the direction opposite to the flying direction and out of the projectile, and a projecting edge operative to permit the countermass to pass out of the projectile and to receive the piston therein, and to engage, brake and compress the piston as it is displaced in the direction opposite to the flying direction and passes the projecting edge, thereby sealing the projectile and retaining the gases formed by combustion of the propellant charge within the projectile; and a launching device comprising a barrel operative to receive the projectile, the barrel extending in the firing direction and having a muzzle opening in the flying direction and having a rear opening, and the barrel having a length such that the projectile leaves the muzzle simultaneously with the countermass leaving the rear opening.

5. The weapon according to claim 4, wherein the barrel further comprises a sight.

* * * * *